United States Patent [19]

Mitchell et al.

[11] 4,172,819

[45] Oct. 30, 1979

[54] HIGH INTENSITY MAGNETIC SEPARATOR ROTOR

[75] Inventors: David W. Mitchell, Jacksonville; Arnold H. Jackson, Orange Park, both of Fla.

[73] Assignee: Carpco, Inc., Jacksonville, Fla.

[21] Appl. No.: 909,377

[22] Filed: May 26, 1978

[51] Int. Cl.[2] ..... B03C 1/14

[52] U.S. Cl. ..... 209/11; 209/223 A

[58] Field of Search ..... 209/223 A, 223 R, 219, 209/11; 210/222, 223

[56] References Cited

U.S. PATENT DOCUMENTS

| | | | |
|---|---|---|---|
| 901,368 | 10/1908 | Payne | 209/219 |
| 944,699 | 12/1909 | Snyder | 209/219 |
| 1,696,387 | 12/1928 | Crowe | 209/219 X |
| 2,177,809 | 10/1939 | Queneau | 209/219 |
| 2,862,619 | 12/1958 | Stearns et al. | 209/216 |

FOREIGN PATENT DOCUMENTS

| | | | |
|---|---|---|---|
| 1936658 | 1/1971 | Fed. Rep. of Germany | 209/223 A |

*Primary Examiner*—Ralph J. Hill

*Attorney, Agent, or Firm*—George H. Baldwin; Arthur G. Yeager

[57] ABSTRACT

The rotor comprises an elongated hollow cylinder and hollow stub shafts affixed to and extending outwardly of each end portion of the cylinder, such cylinder interior being in fluid communication with the interiors of the shafts so that cooling fluid passes therebetween to reduce the heat build up of the cylinder and the transfer of heat to the rotor support beraings, and to conserve energy by substantially reducing the mass of the rotor. Fan blades may be located in and attached inwardly of the shaft or the cylinder to force cooling air therethrough.

25 Claims, 4 Drawing Figures

HIGH INTENSITY MAGNETIC SEPARATOR ROTOR

BACKGROUND OF THE INVENTION

1. Field of the Invention

An improved rotor for a high intensity magnetic separator is disclosed herein, and particularly the invention relates to a hollow elongated cylinder with hollow stub shafts at respective ends and forced air circulation therethrough for cooling of such rotor.

2. Description of the Prior Art

Various hollow rotors for magnetic separators have been disclosed by the prior art, among which are U.S. Pat. Nos.: 791,494—Payne; 901,368—Payne; 2,177,809—Queneau; 2,748,940—Roth; and 2,862,619—Stearns et al. A hollow roll, filled with iron powder, is dislosed by Palasvirta et al.—U.S. Pat. No. 3,024,910.

Other art which seem to generally relate to the invention herein disclosed and claimed are: U.S. Pat. Nos. 762,753—Payne; 832,822—Wait et al.; 994,871—Payne; 1,068,453—Rowand; 1,958,521—Payne; 2,045,098—Payne; and 2,065,460—Johnson.

The aforementioned prior art suffers from various difficulties and present many problems which are effectively alleviated in accord with this invention. The state of the art in seeking to increase machine capacity has increased length and diameter of rolls requiring greater power to energize same. Such rolls have a greater tendency to bend, particularly adjacent the central portion. Even for a solid roll of a rather large diameter of 4–6 inches and with a length of greater than 30 inches, and more particularly about 36 to 50 inches, presents many structual problems, as well as, power requirements for such solid rolls. U.S. Pat. No. 3,024,910 appears to provide an improved rotor with loosely filled iron powder, but such construction, while possibly being preferable to solid rotors, does retain some of the same, while partially alleviated, problems of energy losses due to magnetic hysteresis and generation of eddy currents with detrimental bending and heating of such filled rotor.

SUMMARY OF THE INVENTION

A rotor for use in a high intensity magnetic separator having spaced and opposed pole pieces on either side of the rotor and powered by a magnetic circuit and a splitter below the space for separating non-magnetic particles from feebly magnetic particles, in accord with this invention comprises an elongated hollow cylinder having opposite end portions and hollow shaft means connected to and rotatably supporting the cylinder. The hollow shaft means has opposite end portions extending outwardly from respective cylinder end portions with the hollow interiors of the cylinder and shaft means being in fluid communication whereby cooling fluid communicates between the interiors to reduce the heat build up induced into the cylinder by the magnetic circuit.

In other aspects of the invention the axes of the cylinder shaft means, which includes a pair of hollow stub shafts rigidly attached to respective cylinder end portions, are coincident and disposed substantially horizontally when installed between the separator pole pieces. Means for forcibly passing cooling fluid through the interiors of each stub shaft and cylinder is provided by, for example, a fan blade attached within one of the interiors, preferably the larger of the two, namely the cylinder interior. The fan blade should be non-magnetic when attached within the cylinder and, if desired, a pair of spaced fan blades may be provided within the cylinder to balance the rotor and increase the flow of air therethrough as the rotor rotates.

A disc having an opening therethrough is rigidly affixed to each cylinder end portion with the end portion of each stub shaft corresponding to and being disposed in respective disc opening and being rigidly connected to the inner surface and the outer surface of its disc.

The thickness of the wall defining the interior hollow of and the diameter of each of the stub shafts is less than the thickness of the wall defining the interior hollow of and the diameter of the cylinder. A plurality of magnetic discs and non-magnetic discs alternately are disposed about and substantially throughout the outer surface of the cylinder and selectively releasable non-magnetic end caps are disposed on and connected to each cylinder end portion for forcibly sandwiching the plurality of discs therebetween.

Accordingly, a general object of this invention is to provide an improved hollow rotor which minimizes eddy currents and magnetic hysteresis losses.

A particular object is to provide a rotor having a hollow cylinder with hollow stub shafts mounting such cylinder for the passage of cooling fluid therethrough.

A related particular object is to reduce the rate of heat generation of and resulting elevated temperature in the rotor whereby energy losses and bending thereof are minimized.

A specific object is the provision of a hollow rotor of a minimum amount of magnetically permeable material for minimizing energy losses while maintaining a sufficient magnetic flux path to effect efficient separation of materials, but with a maximum diameter to provide maximum strength from bending forces exerted thereon.

Another specific object is to increase the bending strength of the rotor while substantially decreasing the mass thereof whereby energy and material requirements are diminished.

A further specific object is to reduce the amount of heat transferred to the bearings supporting the rotor thus reducing bearing temperatures, minimizing lubrication problems and increasing bearing life.

Other objects relate to the ease of construction, and the durability and the efficiency of use of the improved rotor in a high intensity magnetic separator.

BRIEF DESCRIPTION OF THE DRAWING

The novel features which are believed to be characteristic of this invention are set forth with particularity in the appended claims. The invention itself, however, both as to its organization and method of operation, together with further objects and advantages therof, may best be understood by reference to the following description taken in connection with the accompanying drawing, in which:

DESCRIPTION OF THE PREFERRED EMBODIMENT

Figure 1:
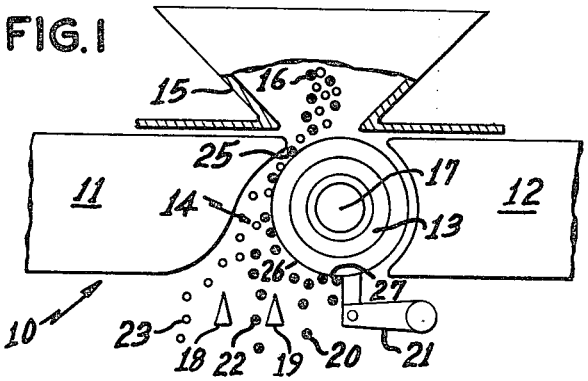
FIG. 1 is a side elevational view, partially in section, of a portion of a high intensity magnetic separator with a hollow rotor constructed in accord with this invention.

Referring now more particularly to the drawings, a high intensity magnetic separator is generally depicted by reference numeral 10 and is seen to include spaced apart primary pole piece or nose block 11 and secondary pole piece or tail block 12 and rotor 13 rotatably mounted in and substantially occupying the space 14 between nose and tail blocks 11 and 12. A feed hopper 15 is supported above the rotor 13, such hopper normally feeding materials 16, consisting of weakly magnetizable particles entrained within a granular mixture of materials, by gravity to rotor 13 throughout substantially its length, as is common in the art. The longitudinal axis 17 of the elongated rotor 13 is substantially horizontal. Below rotor 13, spaced splitters 18 and 19 are positioned for diverting the magnetic particles 20 into a bin (not shown) adjacent brush roll cleaner device 21, middling particles 22 into an adjacent bin, and the non-magnetic particles 23 into the next adjacent bin in a manner known in the art.

Material to be separated should be sufficiently dry for particulate flow thereof so that magnetically susceptible particles are physically separable from non-susceptible particles. The particle size range should be small, the maximum particle size being limited by the separation gap 25 to about 2.00 mm (9 mesh Tyler) and the minimum to a small percentage minus 0.053 mm (270 mesh Tyler). Strongly magnetizable materials, such as magnetite or abraided iron, must be largely removed with a magnetic scalper or the like before feeding to the high intensity induced-roll separator 10 because such magnetite or iron will not pass the separating gap 25 and often must be periodically removed therefrom to unclog the feed hopper 15 adjacent separating gap 25.

Separation of weakly magnetizable materials from a granular mixture 16 requires high magnetic fields and magnetic field gradients. The rotor 13 includes alternate magnetic and non-magnetic circumferential zones 30 and 31 turning between the shaped poles 11 and 12 which are suitably powered through a magnetic circuit (not shown) in the form of a conventional yoke carrying windings for producing a magnetic field of proper intensity across the poles 11 and 12. The alternate magnetic and non-magnetic zones result in concentration of the magnetic flux between the primary pole piece 11 and the rotor 13 in the magnetic zones 30 of the rotor thus creating a high magnetic gradient in the magnetic field. The induced magnetic polarity of the magnetic zones changes continuously as the rotor 13 turns so that the separating gap 25 between the rotor 13 and the nose block 11 contains a high magnetic field and field gradient during operation of the separator.

The more magnetically susceptible materials 20 are easily magnetized in the high magnetic field and thus are attracted to rotor 13 in the high magnetic gradient at the magnetic zones of the rotor surface 26. Magnetic particles 20 are carried around with the rotor surface 26 and fall, or are scraped by brush device 21 from the rotor surface 26, in the region 27 of low magnetic field strength. Non-magnetic particles 23 leave the rotor 13 and follow inertial paths outwardly away therefrom. Middling particles 22 travel to an intermediate location between the magnetic particles 20 and the non-magnetic particles 23 as illustrated in FIG. 1, if separation of such middling particles 22 is desired.

Figure 2:
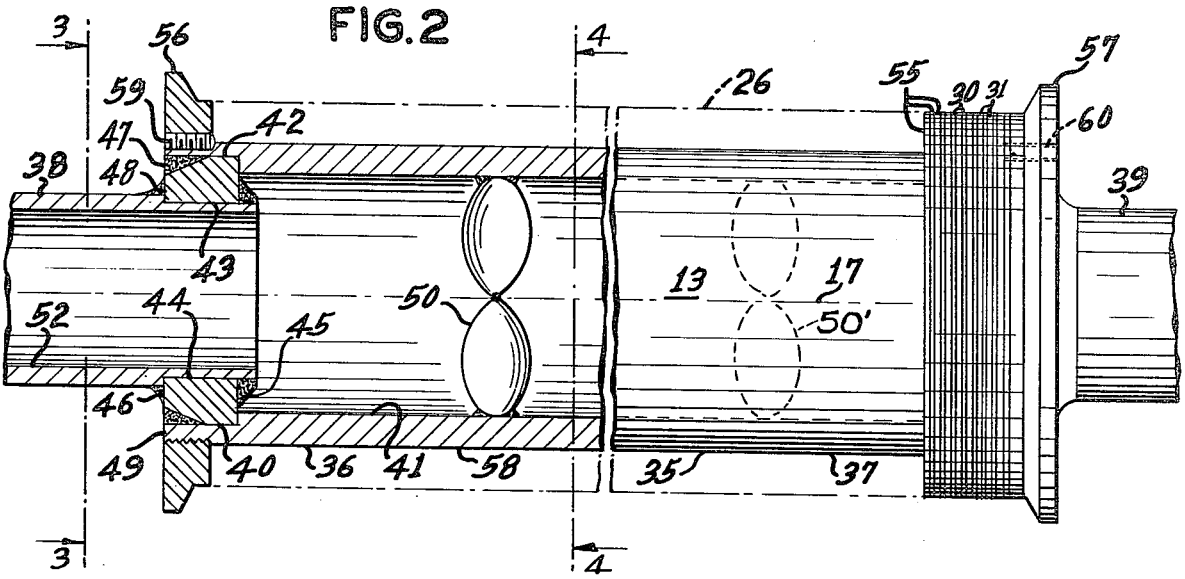
FIG. 2 is a side elevational view, partially in section, of the rotor of FIG. 1.
Figure 3:
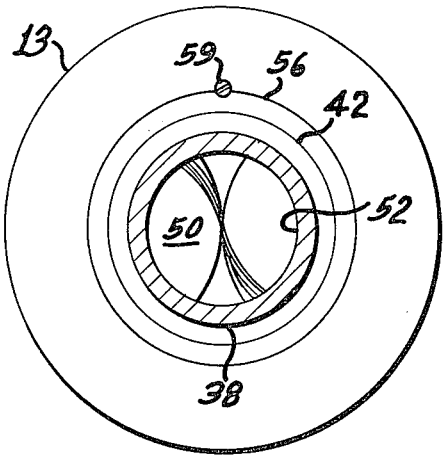
FIG. 3 is a cross-sectional view taken along line 3—3 of FIG. 2.
Figure 4:
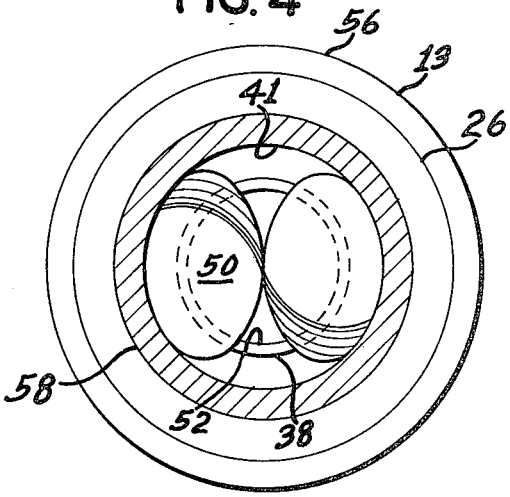
FIG. 4 is a cross-sectional view taken along line 4—4 of FIG. 2.

The constructional details of rotor 13 are more clearly understood by reference to FIGS. 2, 3 and 4. The common solid rotor is usually of magnetic steel of high permeability and subject to substantial heating during operation thereof in the high intensity field of the separator. Also, such rotor is designed to be sufficiently thick and heavy particularly as the rotor is made longer to resist bending thereof in such field. Accordingly, a greater amount of power is needed to rotate such long and solid rotors.

In accord with this invention the rotor 13 includes an elongated hollow cylinder 35 having opposite end portions 36 and 37 with hollow shaft means in the form of stub shafts 38 and 39 projecting outwardly from cylinder 35 and being rigidly connected thereto. The connection of stub shaft 38 to cylinder 35 will be described, it being understood that stub shaft 39 is similarly fabricated. The end portion 36 of cylinder 35 is reamed out to provide an enlarged seat 40 having a diameter greater than the hollow or interior 41 of the cylinder 35. The inward extent of the reamed out seat 40 is determined by the width of the disc 42 to be disposed in seat 40. Disc 40 has an opening 43 extending laterally therethrough for receiving the reduced end portion 44 of the stub shaft 38. The sides of disc 42 are welded by circumferential welds 45 and 46 to rigidly affix stub shaft 38 to disc 42. Thereafter, disc 42 is positioned onto seat 40 with the longitudinal axes 17 of cylinder 35 and stub shaft 38 in horizontal alignment before circumferential weld 47 affixes disc 42 to the cylinder 35, such that the outer surface 48 of the disc 42 is generally co-planar with the cylinder edge 49.

Before connecting disc 42 and stub shaft 38 to cylinder 35, means in the form of a non-magnetic fan blade 50 of suitable material, such as, stainless steel, brass or nylon is affixed, preferably adjacent end portion 36, to the cylinder 35, so that as the cylinder rotates cooling fluid is forcibly passed through, for example, stub shaft hollow 52 into the cylinder hollow 41 and out the hollow (not shown) of stub shaft 39. Another fan blade 50', shown by broken lines in FIG. 2, may similarly be mounted within cylinder 35 adjacent end portion 37 to further assist moving of the air therethrough in the same direction as fan blade 50. While two fan blades are disclosed herein which when equally spaced from the ends of cylinder 35 tends to more evenly balance the rotor, etc., it is clear that a single blade may suffice, and/or the fan blades may be located in the stub shaft hollows, and/or a separate blower may be used to pass air or other fluid therethrough.

After locating alternate discs 55 of magnetic material forming circumferential magnetic zones 30 and alternating non-magnetic material forming circumferential non-magnetic zones 31, non-magnetic end caps 56 and 57 are theaded onto the outer cylinder surface 58 adjacent respective end portions 36 and 37 to tightly sandwich therebetween the discs 55 forming the laminated assembly of the rotor, such end caps being secured in place by respective set screws 59 and 60.

The parameters for providing a large diameter rotor which is of a very long length, but is resistant to the tremendous bending forces, while maintaining a sufficient flux path, are not readily ascertainable. Thus with an outer diameter of 4 inches for the cylinder 35 and with a length of such cylinder being approximately 40 inches in length, the ratio of the inner to outer diameter should be equal to or greater than 0.75 and less than or equal to 0.90. This range is valid where the inner diameter of the hollow cylinder is equal to or greater than 3 inches. In the specific embodiment disclosed herein the following parameters have been found to provide good overall characteristics in accord with the objects set forth above:

O.D. of cylinder 35: 4 inches
I.D. of cylinder 35: 3 5/16 inches
O.D. of stub shafts 38 and 39: 2 7/16 inches
I.D. of stub shafts 38 and 39: 2 1/16 inches
Length of cylinder 35: 40½ inches
Length of stub shafts: 10¼ inches—stub shaft 38 carrying the driving member (not shown) 6½ inches—stub shaft 39

The actual mass reduction between the hollow cylinder above and the solid prior art cylinder of the same O.D. is approximately 68%. This reduction will reduce the power requirements, etc., as hereinabove set forth. Also, the hollow shaft as compared to the solid shaft of the same O.D. reduces its mass by about 71% while providing a cooling fluid path through such stub shafts 38 and 39 and hollow cylinder 35. Accordingly, approximately a 70% mass reduction of the rotor with concomitant reduction of wasted energy as heat generated by magnetic hysteresis and eddy currents in a rotor turning in magnetic fields of up to 20,000 gausses and increased resistance to bending are achieved by this rotor design. Additionally smaller temperature changes due to lower heat generation and increased heat dissipation by forced cooling significantly reduce bearing loads permitting use of lighter-duty bearings.

While the invention has been described with respect to a certain specific embodiment, it will be appreciated that many modifications and changes may be made by those skilled in the art without departing from the spirit of the invention. It is intended, therefore by the appended claims to cover all such modifications and changes as fall within the true spirit and scope of the invention.

What is claimed as new and what it is desired to secure by Letters Patent of the United States is:

1. In a high intensity magnetic separator having spaced pole pieces powered by a magnetic circuit and feed hopper above the space, a splitter below the space for separating non-magnetic particles from feebly magnetic particles and a rotor mounted in the space between said pole pieces for rotation about a horizontal axis, the improvement wherein said rotor comprises an elongated hollow, cylinder having an impervious uninterrupted cylindrical surface defining the interior hollow therein, a hollow shaft means extending outwardly of each end portion of said cylinder and being rigidly affixed to said cylinder for rotatably supporting said cylinder, each said hollow shaft means having an interior communicating with said interior of said hollow cylinder whereby cooling fluid may be communicated through all of said interiors to reduce the heat build up induced into said hollow cylinder by said magnetic circuit.

2. In the separator as defined in claim 1 wherein said hollow shaft means include spaced end portions outwardly of said cylinder, further comprising means for forcibly passing cooling fluid through one of said end portions into said interior of said cylinder and out the other of said end portions to reduce the temperature of said cylinder.

3. In the separator as defined in claim 2 wherein said means for forcibly passing comprises a fan blade in one of said interiors for passing air therethrough.

4. In the separator as defined in claim 3 wherein said fan blade is non-magnetic and attached to said cylinder interiorly thereof.

5. In the separator as defined in claim 2 wherein said means for forcibly passing comprises a pair of spaced non-magnetic fan blades attached interiorly of said cylinder adjacent respective said end portions.

6. In the separator as defined in claim 2 wherein said shaft means includes a pair of hollow stub shafts rigidly connected to respective said end portions of said cylinder.

7. In the separator as defined in claim 1 wherein said shaft means includes a pair of spaced discs having openings therethrough and being respectively connected rigidly to respective said end portions of said cylinder, said shaft means further including a pair of hollow stub shafts having end portions of a predetermined configurations mating within respective said openings in and rigidly connected to said discs.

8. In the separator as defined in claim 7 wherein said openings and said stub shaft end portions are round, said end portions of said stub shafts extending inwardly of respective said discs, said stub shafts being welded to each side of its said discs.

9. In the separator as defined in claim 1 further comprising a plurality of magnetic discs and non-magnetic discs alternately disposed about and substantially throughout the outer surface of said cylinder, a pair of selectively releasable non-magnetic end caps respectively attached to respective said end portions of said cylinder for sandwiching said plurality of discs therebetween.

10. In the separator as defined in claim 1 wherein said hollow cylinder has a ratio range of inner to outer diameter equal to or geater than 0.75, when the inner diameter is equal to or greater than three inches, and less than about 0.9.

11. A rotor for use in a high intensity magnetic separator having spaced and opposed pole pieces on either side of the rotor and powered by a magnetic circuit and a splitter below said space for separating non-magnetic particles from feebly magnetic particles, said rotor comprising an elongated hollow, cylinder having an impervious uninterrupted cylinder surface defining the interior hollow therein and having opposite end portions, hollow shaft means connected to said cylinder for rotatably supporting same and having opposite end portions extending outwardly from respective said end portions of said cylinder with the hollow interiors of said shaft means end portions in fluid communication with said hollow cylinder interior whereby cooling fluid communicates through all of said interiors to reduce heat build up induced into said cylinder by a magnetic circuit.

12. The rotor as defined in claim 11 wherein said cylinder and said shaft means have coincident axes disposed substantially horizontally when installed between pole pieces of a separator.

13. The rotor as defined in claim 11 wherein said shaft means includes a hollow stub shaft rigidly attached to each said cylinder end portion.

14. The rotor as defined in claim 11 further comprising means for forcibly passing cooling fluid through said interiors of each said shaft means and cylinder.

15. The rotor as defined in claim 14 wherein said means for forcibly passing cooling fluid includes a fan blade attached within one of said interiors.

16. The rotor as defined in claim 15 wherein said fan blade is non-magnetic and attached to said cylinder interior.

17. The rotor as defined in claim 14 wherein said means for forcibly passing cooling fluid includes a non-magnetic fan blade mounted within said cylinder interior adjacent each end portion thereof for passing the cooling fluid in one direction caused by the rotation of the rotor.

18. The rotor as defined in claim 11 wherein said shaft means includes a disc having an opening therethrough and being rigidly connected to each said cylinder end portion, said shaft means further including a hollow stub shaft having an end portion corresponding to and disposed in said opening of each said disc and being rigidly connected thereto.

19. The rotor as defined in claim 18 wherein each said stub shaft and said cylinder have coincident axes disposed substantially horizontally when installed between pole pieces of a separator.

20. The rotor as defined in claim 18 wherein each of said stub shafts is rigidly connected to the inner surface and the outer surface of said disc.

21. The rotor as defined in claim 11 wherein said shaft means includes a hollow cylindrical shaft extending outwardly of each said cylinder end portion.

22. The rotor as defined in claim 21 wherein the diameter of said shaft is less than the diameter of said cylinder.

23. The rotor as defined in claim 21 wherein the thickness of the wall defining the interior hollow of said shaft is less than the thickness of the wall defining the interior hollow of said cylinder.

24. The rotor as defined in claim 11 further comprising a plurality of magnetic discs and non-magnetic discs alternately disposed about and substantially throughout the outer surface of said cylinder.

25. The rotor as defined in claim 24 further comprising a selectively releasable non-magnetic end cap disposed on and connected to each said end portion for forcibly sandwiching said plurality of discs therebetween.

* * * * *